US008342388B2

(12) United States Patent
Labbe et al.

(10) Patent No.: US 8,342,388 B2
(45) Date of Patent: Jan. 1, 2013

(54) CRIMPING MARKS REDUCING WRAPPER FOR ROLLS

(75) Inventors: Michel Labbe, Victoriaville (CA); Richard Scott Bowden, Tolland, CT (US)

(73) Assignee: Cascades Conversion, Inc., Kingsey Falls (CA)

( * ) Notice: Subject to any disclaimer, the term of this patent is extended or adjusted under 35 U.S.C. 154(b) by 1467 days.

(21) Appl. No.: 11/861,692

(22) Filed: Sep. 26, 2007

(65) Prior Publication Data

US 2009/0078748 A1 Mar. 26, 2009

(51) Int. Cl.
*B65D 65/00* (2006.01)

(52) U.S. Cl. ..... 229/87.01; 206/410

(58) Field of Classification Search ..... 229/87.01; 206/410

See application file for complete search history.

(56) References Cited

U.S. PATENT DOCUMENTS

| | | | | |
|---|---|---|---|---|
| 2,510,120 | A | 6/1950 | Leander | |
| 2,883,045 | A * | 4/1959 | Abramson | 206/396 |
| 3,862,099 | A | 1/1975 | Marans | |
| 4,858,762 | A | 8/1989 | Kewin | |
| 5,090,566 | A | 2/1992 | Yount | |
| 5,114,012 | A | 5/1992 | Mushinski et al. | |
| 5,131,209 | A | 7/1992 | Schreiber et al. | |
| 5,392,585 | A * | 2/1995 | Wall | 53/136.2 |
| RE35,241 | E | 5/1996 | Capy et al. | |
| 5,850,918 | A | 12/1998 | Pienta | |
| 6,179,123 | B1 * | 1/2001 | Shigeta et al. | 206/410 |
| 6,186,326 | B1 | 2/2001 | Pienta et al. | |
| 6,446,804 | B1 | 9/2002 | Lehtineva | |
| 7,404,485 | B2 * | 7/2008 | Uitenbroek | 206/410 |
| 7,913,895 | B2 * | 3/2011 | Bowden et al. | 229/87.01 |
| 2001/0040112 | A1 * | 11/2001 | Pienta | 206/413 |
| 2002/0033350 | A1 * | 3/2002 | Itkonen et al. | 206/410 |
| 2002/0090508 | A1 | 7/2002 | Nowak et al. | |
| 2002/0192406 | A1 * | 12/2002 | Labbe et al. | 428/34.2 |
| 2006/0277866 | A1 | 12/2006 | Bowden et al. | |
| 2007/0272574 | A1 | 11/2007 | Uitenbroek | |

FOREIGN PATENT DOCUMENTS

| | | |
|---|---|---|
| CA | 2153394 | 7/1994 |

OTHER PUBLICATIONS

European Search Report dated Sep. 14, 2009 for European Application No. 08 16 5169.7.

Disclosure Statement Under 37 C.F.R. § 1.56 for U.S. Appl. No. 11/861,692.

* cited by examiner

*Primary Examiner* — Nathan J Newhouse
*Assistant Examiner* — Derek Battisti
(74) *Attorney, Agent, or Firm* — Sutherland Asbill & Brennan LLP

(57) ABSTRACT

A wrapper for wrapping on a roll of length L having two opposed roll ends is described. The wrapper comprises an interior layer of a length Wi and of an interior layer basis weight, adapted to be adjacent the roll when the wrapper is wrapped on the roll; an exterior layer of a length We longer than the length Wi of the interior layer forming at least one end strip of width S and of an exterior layer basis weight, adapted to be outside of the roll when the wrapper is wrapped on the roll. The interior layer basis weight is different from the exterior layer basis weight. The end strip of the exterior layer is adapted to be folded on a corresponding one of the roll ends during crimping following wrapping of the wrapper on the roll.

20 Claims, 8 Drawing Sheets

Winding

Wrapping

Headers introduction

Crimping

Heat Sealing

CRIMPING MARKS REDUCING WRAPPER FOR ROLLS

FIELD OF THE INVENTION

The present invention relates to protective wrappers for rolls to reduce crimping marks on roll ends.

DESCRIPTION OF THE PRIOR ART

Newsprint and other forms of paper are manufactured and processed as large elongated sheets or webs. As shown in FIG. 1 (Prior Art), for storage and transport, the paper stock is wrapped around a core plug to form a cylindrical roll, a step known as winding (FIG. 1A). The rolls are very heavy. A typical roll may range from 25 to 72 inches in diameter and, sometimes, as large as 145 inches or more. To protect the roll from moisture, the atmosphere, and physical abrasions, the roll itself is wrapped in a protective wrapping (FIG. 1B) which can be moisture proof. Specialized machinery is employed to automatically apply the wrapper to the large rolls. Typically, the rolls are then stacked one on the other and stored on end.

Various methods have previously been used to wrap paper rolls. One of the most successful methods has been to first wrap the roll in one or two layers of a protective wrapper (FIG. 1B), with the wrapper extending outwardly beyond the ends of the roll. Next, optional interior roll headers (disks formed of corrugated cardboard, chipboard, coated chipboard or laminated kraft paper) are fitted inside the wrapper against the ends of the roll (FIG. 1C). The wrapper is then crimped over the edges of the interior headers at the ends of the rolls using a crimping wheel or any other appropriate technique (FIG. 1D). If no inside roll headers are used, the wrapper is crimped directly onto the roll of paper. Crimping creates many small surfaces that are characterized by several wrapper layers in thickness: three plies per wrap turn plus three more plies for the overlapping section (see FIG. 2).

A set of exterior or outside roll headers (somewhat thinner disks typically formed of a kraft paper with a polymer coating on the inside surface) are then attached to the ends of the roll over the crimped edges (FIG. 1E). The headers and the wrapper are held in place and affixed to one another through the use of an adhesive, such as a heat sensitive adhesive (a polymer coating), on the inside surface of the exterior roll header and/or the outward face of the interior roll header.

The exterior roll headers are affixed to the ends of the rolls in a typical roll wrapping machine by applying heat and/or pressure in accordance with the properties of the adhesive used. To heat-seal the roll, pressure and high temperature are necessary. This step is known to create crimping marks on the roll ends because of the wrapper crimps that absorb energy from the heat-seal platens.

When the rolls are stacked on end, the crimps crush the edge of the roll and produce indentation. Damage to the paper rolls incurs financial burden to the purchaser, the manufacturer, and/or the transporter.

Crimping marks are generally created during the heat sealing process, the warehousing, the stacking of the rolls and the transportation (mainly due to vibrations and roll dropping). The crimping marks creation varies according to the paper roll density which changes with winding operations and paper grade, the impact stresses due to stacking, the wrapper thickness, the number of wrapper turns, the quality of the crimper and crimp width, the winding quality with offset edge position enhancing crimping marks, the impact strength during roll handling, the stacking procedure, the amount of stacked rolls, the warehousing period, the transportation and restacking, all varying from one mill to another, the transportation mode, rail, boat and truck causing different vibration strengths, the seasonal transportation, the inside headers variations, the position of the roll in the stack (paper roll edge in contact with floor showed more deep crimping marks than those stacked because two roll edges in contact are more compressive than a roll edge in contact with concrete floor). During transportation by a lift truck, the roll is subjected to a clamp force on its sides and by friction along its width as shown in FIG. 3.

The cushioning chipboard header is composed of multiple fiber layers. Headers manufacturers can laminate several chipboards together to obtain a thicker header for better cushioning protection. When a pressure is applied on the top of the header, mainly due to the wrapper crimps, some pressure are absorbed by the spongy chipboard and the remaining pressure is transmitted through the chipboard. This is the transmitted pressure which causes the crimping marks.

By increasing chipboard thickness, the pressure absorbed by the spongy chipboard is increased and the transmitted pressure through the chipboard is reduced, providing a better roll edge protection. So far is was the only known technology used to reduce the crimping marks.

Referring back to FIG. 3, in order to prevent tearing of the wrapper during transport, a minimum of strength is required in the wrapper. The roll will be subjected to forces such as the transverse clamping force, the Tensile Energy Absorption (TEA), etc. In general, a wrapper having a minimum composition of a layer of 100 g/m$^2$+a barrier of 20 g/m$^2$+a layer of 100 g/m$^2$ is believed to be strong enough to withstand the forces the roll is subjected to without tearing. These forces can be approximated to 1 G when in a static position, that is one times the weight of the roll and 3 G, that is three times the weight of the roll when the roll is being transported by a lift truck, for example because of the vibrations and shocks. According to the Technical Association of Pulp and Paper Industry (TAPPI), the wrapper should have a tensile CD of 10 kN/m, a Burst strength of 1000 kPa and a tearing CD of 3.5 N.

The industry has therefore developed typical wrapper design which respect these recommendations. An example of a water-vapour-proof wrapper design protection is two linerboards laminated with a barrier like Polyethylene (PE). A coated linerboard with a similar barrier can also be used. Examples of such wrapper designs are indicated in Table 1 below.

TABLE 1

Examples of typical wrapper designs.

| Design | Composition (layers) | Thickness range. |
|---|---|---|
| Laminated - type 1 | 126 g/m$^2$ + barrier + 126 g/m$^2$ | 325-475 microns |
| Laminated - type 2 | 161 g/m$^2$ + barrier + 161 g/m$^2$ | 425-575 microns. |
| Coated | 269 g/m$^2$ + barrier | 350-450 microns. |

Two wrapper layers around the paper roll with a crimped section is nine wrapper plies for a thickness range of 9 times the wrapper thickness. During the stacking process, the wrapper can be compressed up to 25% as measured on a crimp sample after a long stacking strength (pressure and time).

Also, the wrapper thickness reduction is limited by the minimal wrapper strength needed to wrap a paper roll. For that reason, the reduction of the wrapper thickness is a limited technique to reduce the crimping marks. The stresses involved during the roll transportation (lift, truck, conveyor, etc.) limit the wrapper thickness decreasing since the tearing strength in both the machine direction (MD) and the cross-direction (CD), the tensile strength, the tearing strength, the bursting strength, the TEA and the stiffness are all critical physical properties needed to ensure integrity of the rolls.

BRIEF SUMMARY OF THE INVENTION

It is therefore an aim of the present invention to address the above mentioned issues.

An aspect of the invention provides a wrapper for wrapping on a roll of length L having two opposed roll ends. The wrapper comprises an interior layer of a length Wi and of an interior layer basis weight, adapted to be adjacent the roll when the wrapper is wrapped on the roll; an exterior layer of a length We longer than the length Wi of the interior layer forming at least one end strip of width S and of an exterior layer basis weight, adapted to be outside of the roll when the wrapper is wrapped on the roll. The interior layer basis weight is different from the exterior layer basis weight. The end strip of the exterior layer is adapted to be folded on a corresponding one of the roll ends during crimping following wrapping of the wrapper on the roll.

According to a general aspect, there is provided a protective wrapping paper for a roll having two spaced-apart roll ends and an outer roll surface extending between the roll ends on a length L. The protective wrapping paper comprises: an interior paper layer of a length Wi and of an interior layer basis weight, the interior paper layer being juxtaposed to the outer roll surface when the wrapping paper is wrapped on the roll; and an exterior paper layer of a length We, longer that the length Wi of the interior paper layer, and of an exterior layer basis weight, different from the interior layer basis weight, the exterior paper layer being superposed to the interior paper layer and defining therewith at least one end strip of a width S foldable on a corresponding one of the roll ends.

According to another general aspect, there is provided a method for wrapping a roll of length L having a pair of spaced-apart roll ends and an outer roll surface extending between the roll ends, comprising: providing a wrapping paper having an interior layer of a length Wi and of an interior layer basis weight and an exterior layer of an exterior layer basis weight different from the interior basis weight and of a length We longer than the length Wi of the interior layer, the length difference between the interior layer and the exterior layer defining at least one end strip of width S; wrapping the roll with the wrapping paper, the interior layer being superposed to the outer roll surface; and folding the at least one end strip of the exterior layer to a corresponding one of the roll ends.

According to still another general aspect, there is provided a wrapped roll, comprising: a roll of length L having two spaced-apart roll ends and an outer roll surface extending between the roll ends; and a wrapping paper having an interior layer of a length Wi and of an interior layer basis weight and an exterior layer of a length We longer than the length Wi of the interior layer forming at least one end strip of width S and of an exterior layer basis weight, the interior layer being juxtaposed to the outer roll surface, the interior layer basis weight being different than the exterior layer basis weight, the end strip of the exterior layer being folded on a corresponding one of the roll ends.

According to a further general aspect, there is provided a method for shipping a roll of length L having a pair of spaced-apart roll ends and an outer roll surface extending between the roll ends, comprising: wrapping the roll with a wrapping paper having an interior layer of a length Wi and of an interior layer basis weight and an exterior layer of an exterior layer basis weight different from the interior basis weight and of a length We longer than the length Wi of the interior layer, the length difference between the interior layer and the exterior layer defining at least one end strip of width S, the interior layer being superposed to the outer roll surface; and folding the at least one end strip of the exterior layer to a corresponding one of the roll ends; and storing the wrapped roll in a carrier for shipping with the wrapped roll lying on the respective one of the roll ends.

BRIEF DESCRIPTION OF THE DRAWINGS

FIG. 1 (Prior Art) comprises FIG. 1A to FIG. 1E, wherein

It will be noted that throughout the appended drawings, like features are identified by like reference numerals.

DETAILED DESCRIPTION

Figure 1A:
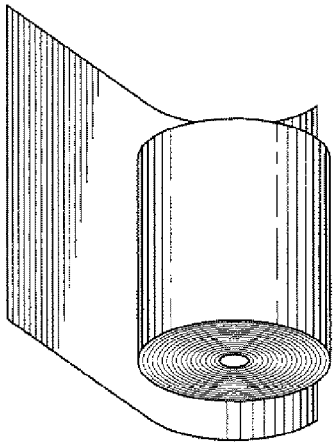
FIG. 1A (Prior Art)
FIG. 1A shows a winding step.
Figure 1B:
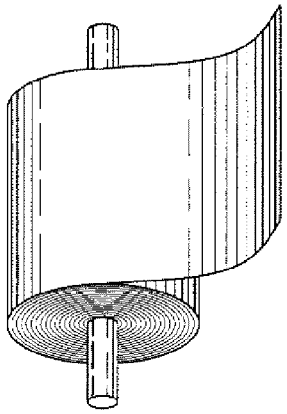
FIG. 1B (Prior Art)
FIG. 1B shows a wrapping step.
Figure 1C:
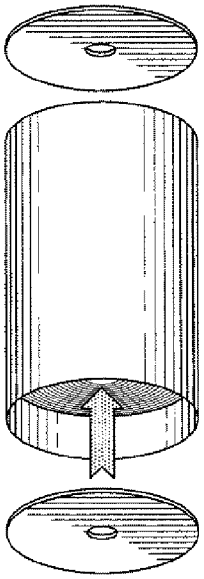
FIG. 1C (Prior Art)
FIG. 1C shows an optional inside headers introduction step.
Figure 1D:
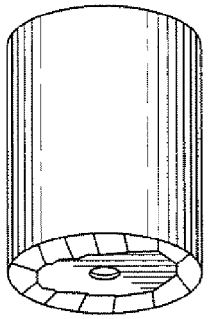
FIG. 1D (Prior Art)
FIG. 1D shows a crimping step and FIG. 1E shows a heat sealing step with exterior headers.
Figure 1E:
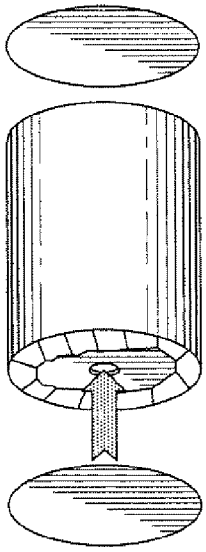
FIG. 1E (Prior Art)
Figure 2:
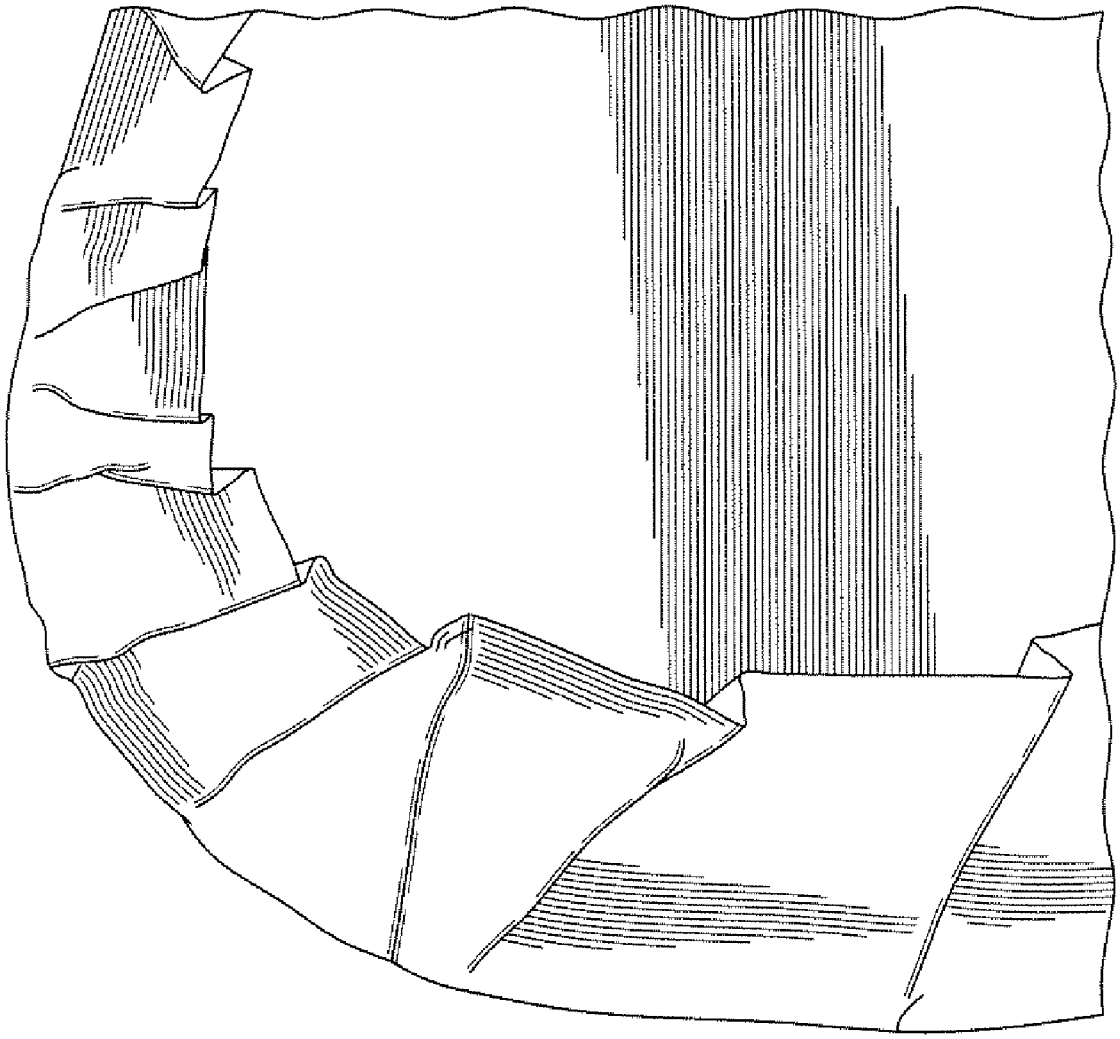
FIG. 2 shows a crimped wrapper on a paper roll with end headers with areas where there are three plies of wrapper and more.
Figure 3:
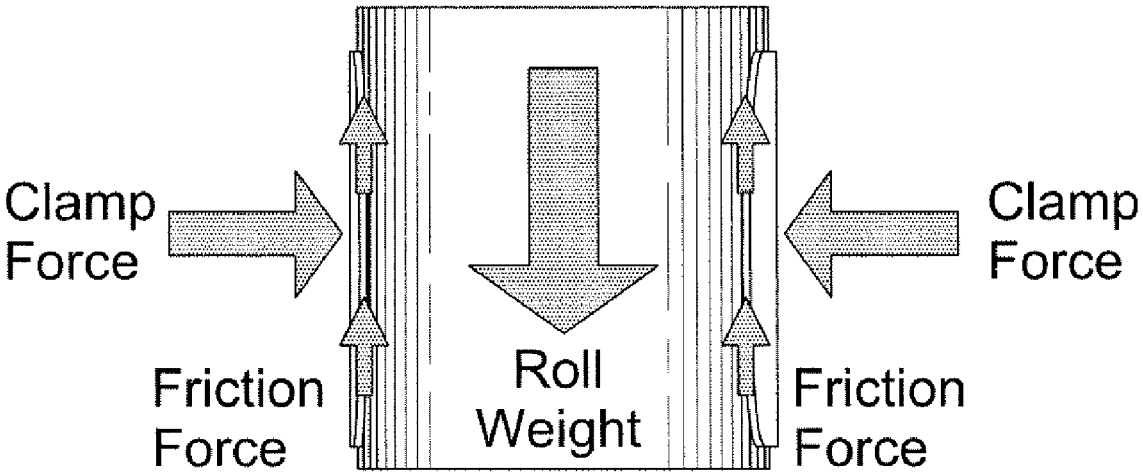
FIG. 3 shows the forces affecting the roll during transport by a lift truck.
Figure 4:
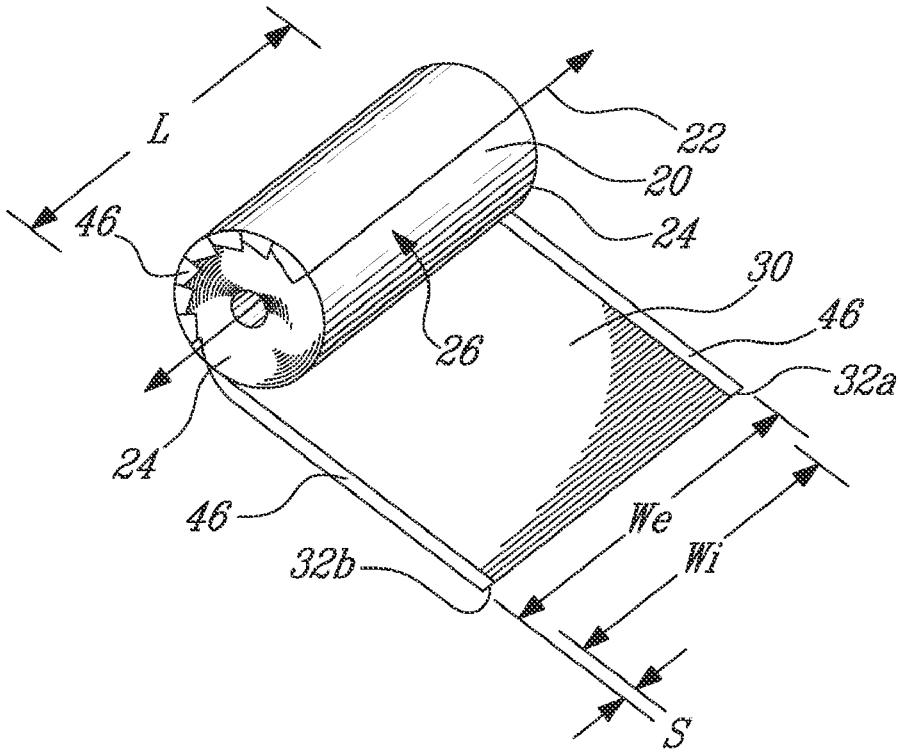
FIG. 4 is a perspective view of a paper roll being wrapped in accordance with an embodiment of the invention.
Figure 5:
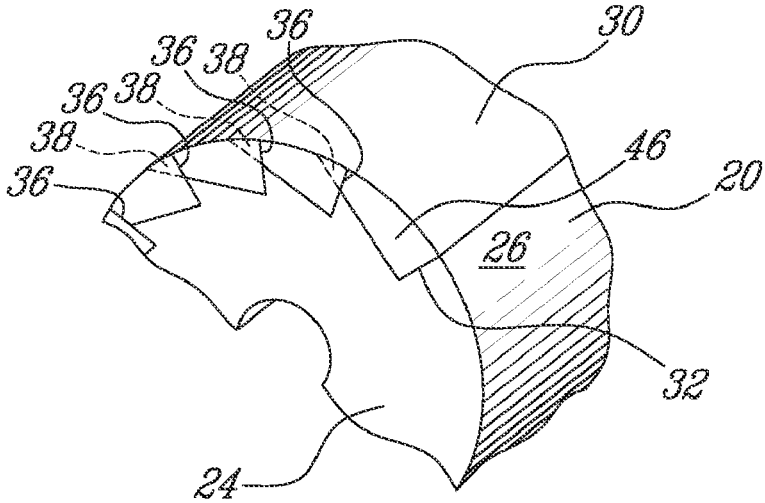
FIG. 5 is a perspective view, fragmented, of a roll end of the paper roll shown in FIG. 4.

Referring now to the drawings and, more particularly, to FIGS. 4 and 5, there is shown a conventional paper roll 20 having a longitudinal roll axis 22, a pair of longitudinally spaced-apart roll ends 24, and an outer roll surface 26 extending between the roll ends 24 and radially spaced along the longitudinal roll axis 22. The roll 20 is characterized by a length L along the longitudinal roll axis 22.

The roll 20 is wrapped with a protective wrapper 30 having a width We, longer than the length L, in a manner such that longitudinal edge strips 32*a*, 32*b* of the wrapper 30 extend outwardly beyond the roll ends 24. The edge (or end) strips 32*a*, 32*b* are spaced-apart from one another with a peripheral strip extending therebetween. In an embodiment, the peripheral strip is substantially equal to the length L of the roll. The edge strips 32*a*, 32*b* of the wrapper 30 typically extend between three to ten inches and, preferably, between four to nine inches, beyond the roll ends 24 but they can be wider or narrower.

Figure 6:
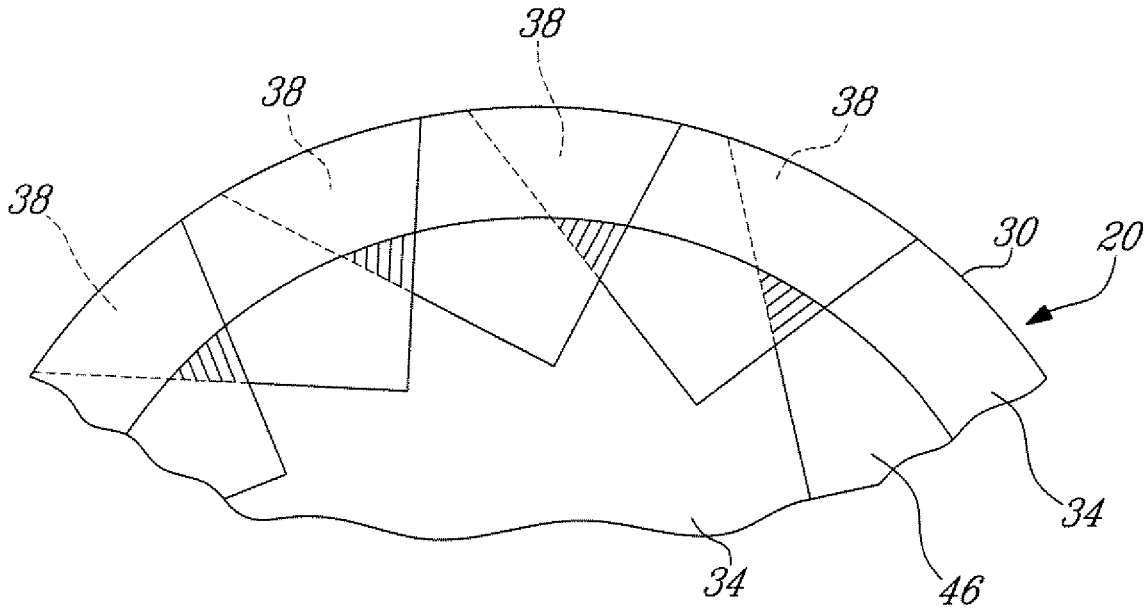
FIG. 6 is a top plan view, fragmented, of a roll end of the paper roll wrapped in the wrapper shown in FIG. 4.

The edge strips 32*a*, 32*b* are crimped using a crimping wheel which hammers the edge strips 32*a*, 32*b* onto the ends 24 of the roll 20. It will appreciated that any other suitable technique can be used to crimp the extending edge strips 32*a*, 32*b*. Each of the edge strips 32*a*, 32*b* of the wrapper 30 overlaps onto itself on the roll ends 24 during the crimping procedure. As the edge strips 32*a*, 32*b* are crimped over the roll ends 24, ridges 36 are produced and part of the wrapper 30 overlaps onto itself forming overlapped areas 38 (FIGS. 5 and 6).

An exterior roll header 42 (FIGS. 7 and 8) is then secured to each of the roll ends 24 over the crimped edge strips 32*a*, 32*b* to complete the protection of the roll 20.

Figure 7:
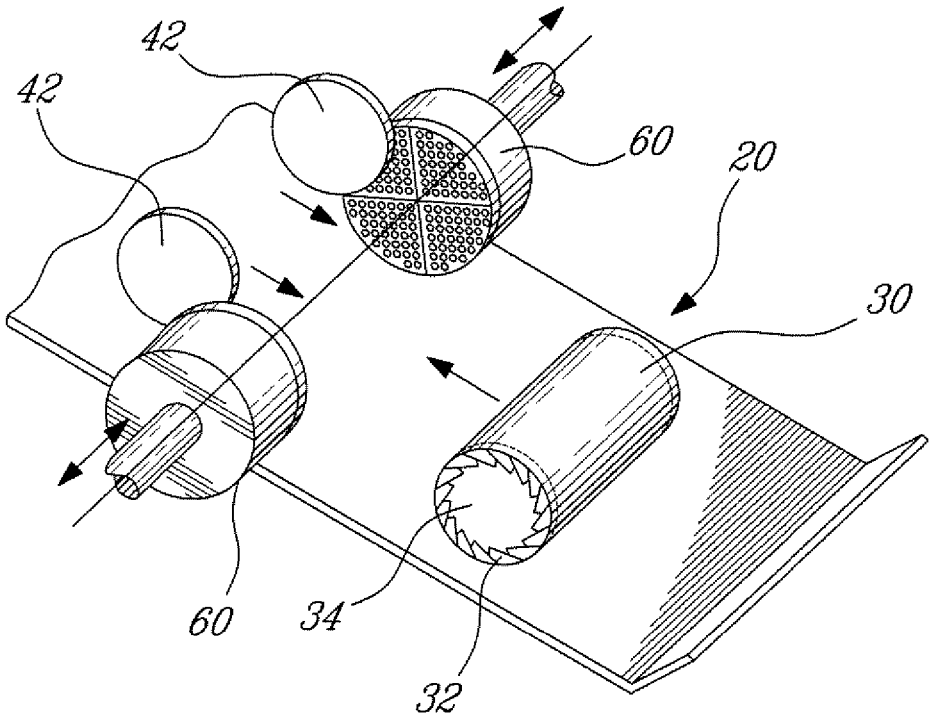
FIG. 7 is a perspective view of a header mounting apparatus showing the positioning of exterior roll headers.
Figure 9:
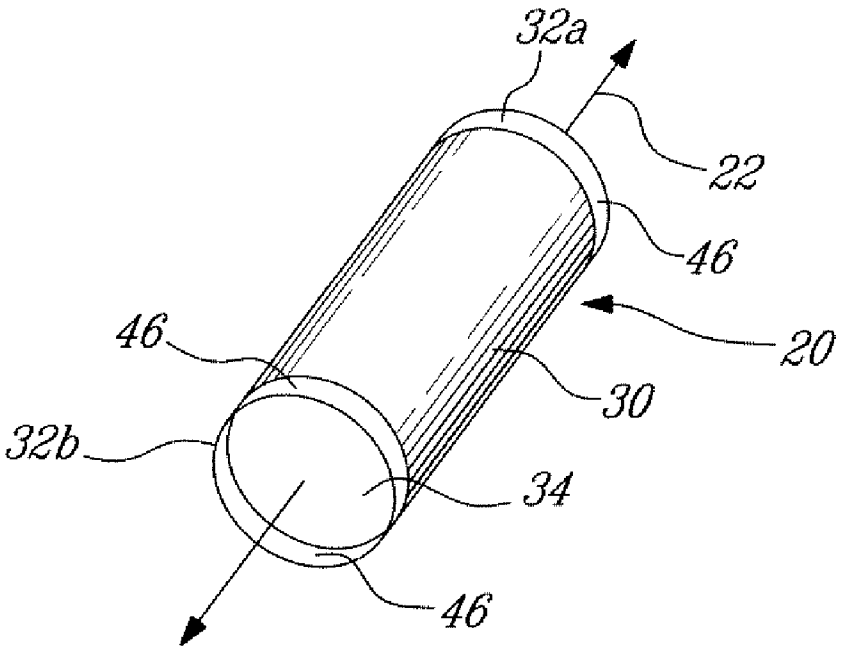
FIG. 9 is a perspective view of the paper roll wrapped in the wrapper of FIG. 4, wherein interior roll headers are juxtaposed to the roll ends.
Figure 8:
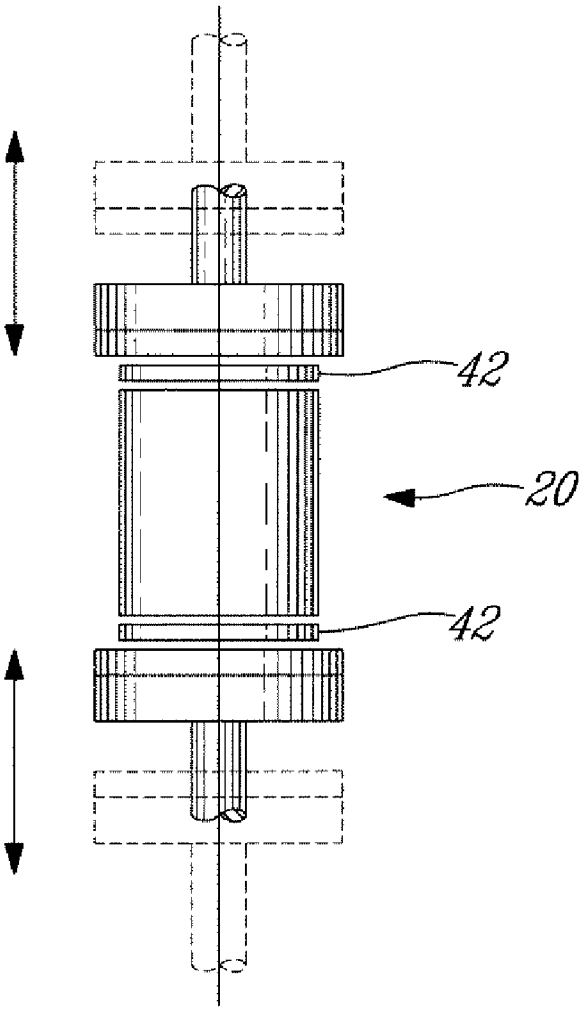
FIG. 8 is a side elevation view of the header mounting apparatus shown in FIG. 7 showing the roll being sandwiched between two exterior roll headers.

Referring now to FIG. 9, it will be seen another embodiment wherein interior roll headers are used. The roll 20 is wrapped into the wrapper 30. Either before or after the wrapper 30 has been applied to the roll 20, interior roll headers 34 (only one is shown) have been juxtaposed to the roll ends 24. The edge strips 32*a*, 32*b* extend beyond the interior roll headers 34. The extending edge strips 32*a*, 32*b* are crimped over the interior roll headers 34 (FIG. 7).

The roll headers 34, 42 are disks formed of corrugated cardboard, chipboard, or laminated kraft paper, for example. The roll headers 34, 42 can have adhesive properties on a face. For example they can be coated with a heat sensitive adhesive such as polyethylene. For the interior roll header 34, the adhesive is on the face opposite to the face in contact with the roll 20, i.e. the face in contact with the crimped edge strips 32. For the exterior roll header 42, the adhesive is on the face in contact with the crimped edge strips 32. Therefore, when activated, if necessary, the adhesive bonds the roll headers 34, 42 to the crimped edge strips 32*a*, 32*b*, as it will be described in more details below.

Referring back to FIG. 4, the wrapper 30 comprises at least two layers. It will be referred to as an asymmetrical wrapper. The interior surface of the wrapper 30 which is in contact with the roll 20 is provided by an interior paper layer having an interior layer basis weight, The exterior surface of the wrapper 30 which is exposed to the surrounding conditions is provided by an exterior layer having an exterior layer basis weight. The interior layer basis weight and the exterior layer basis weight are different. Furthermore, only the exterior layer has edge strips 32A and 32B and has a width of We. The interior paper layer has a width Wi substantially equal to the length L of the roll. The width of the strips 32A and 32B is S=(We−Wi)/2 in the case where both strips have the same width. The interior paper layer is positioned and affixed to the exterior layer in such a manner that it creates at least one strip, such as strips 32A and 32B on the exterior layer. The strips 32A and/or 32B are crimped and therefore, only the exterior layer of the wrapper is crimped. This ensures that the length of the roll is protected by both layers of the wrapper while reducing crimping marks since only one layer, the exterior layer, is crimped.

If the basis weight of the interior layer is greater than the basis weight of the exterior layer and only the exterior layer is crimped, the crimping marks will be induced by the layer with the smallest thickness and therefore will be reduced when compared to a standard design wrapper where both layers of identical thickness are crimped. It should be noted, however, that even if the basis weight of the interior layer is smaller than the basis weight of the exterior layer and only the exterior layer is crimped, the crimping marks will still be reduced when compared to a standard design wrapper where both layers of identical thickness are crimped because only one layer of the wrapper is crimped.

In some cases, the interior paper layer of a width Wi will be slightly larger than the width of the roll L and the interior paper layer will therefore be slightly crimped when the exterior layer is crimped. This will protect the edges of the roll, will not create unacceptable damages to the roll and will still reduce the crimp marks with respect to standard wrappers.

A third layer, with or without moisture barrier properties, can be laminated in between the interior and exterior layers of the wrapper. The third layer may have a width of We or Wi or any width in between We and Wi and will therefore be completely crimped with the exterior layer, will not be crimped at all or will be partially crimped, respectively.

Referring back to Table 1, examples of typical wrapper designs include two or three layers of materials with a thickness range from 325 to 575 microns.

TABLE 1

Examples of typical wrapper designs.

| Design | Composition (layers) | Thickness range. |
|---|---|---|
| Laminated - type 1 | 126 g/m$^2$ + barrier + 126 g/m$^2$ | 325-475 microns |
| Laminated - type 2 | 161 g/m$^2$ + barrier + 161 g/m$^2$ | 425-575 microns. |
| Coated | 269 g/m$^2$ + barrier | 350-450 microns. |

These standard wrapper designs follow the recommendations of the TAPPI. However, a single layer of 126 g/m$^2$ does not follow these recommendations since it has a tensile CD force of 4 to 7 kN/m, a Burst force of 450-650 kPa and a Tear CD force of 1.8-2.2 N. However, if it is crimped and sealed on a header (having a composition of 200 g/m$^2$, for example), the single layer of 126 g/m$^2$ becomes laminated with the header and therefore stronger, yielding a tensile CD force of 15-17 kN/m, a Burst force of 1400-1650 kPa and a Tear CD force of 6.8-7.9 N.

An asymmetrical wrapper design with a total composition of about 252 g/m$^2$ would therefore yield the same acceptable protection for the length of the roll. Similarly, other compositions could be designed to yield a total of about 269 or 322 g/m$^2$. Such an asymmetrical wrapper design could be as follows.

The laminated asymmetrical wrapper of example 3 has a composition of 161 g/m$^2$+barrier+90 g/m$^2$, wherein 161 g/m$^2$+barrier is the crimping zone thickness. The laminated asymmetrical wrapper of example 4 has a composition of 90 g/m$^2$+barrier+161 g/m$^2$, wherein 90 g/m$^2$+barrier is the crimping zone thickness. In some applications, the fact that the crimping zone thickness will be composed of the 90 g/m$^2$+barrier layers will be sufficient to yield the appropriate strength for the application. In other applications, a higher thickness for the crimping zone will be required and then the crimping zone thickness composed of the 161 g/m$^2$+barrier layers can be used. Other combinations of thicknesses of layers can also be used as will be readily apparent to one skilled in the art and examples 3 and 4 are solely exemplary.

Table 2 below shows examples of the wrapper thickness ranges, crimp thickness ranges (which are 3 times the wrapper thickness range) and crimp section thicknesses when the wrapper is compressed by a maximum of 25% in thickness and, for the new designs, the edge thickness with its compressed thickness ranges.

TABLE 2

Thickness ranges for each example design.

| Design | Composition (layers) | Wrapper thickness range | Crimp thickness range | Crimp thickness compressed at 25% | Crimped edge thickness (compressed) ranges |
|---|---|---|---|---|---|
| Laminated - type 1 | 126 g/m$^2$ - Barrier - 126 g/m$^2$ | 325-475 microns | 975-1425 microns | 730-1070 microns | |
| Laminated - type 2 | 161 g/m$^2$ - Barrier - 161 g/m$^2$ | 425-550 microns | 1275-1650 microns | 956-1237 microns | |
| Laminated Asymmetrical Wrapper Example 3 | 161 g/m$^2$ - Barrier - 90 g/m$^2$ | 370-450 microns | 1110-1350 microns | 832-1012 microns | 212-275 microns (159-206 microns) |
| Laminated Asymmetrical Wrapper Example 4 | 90 g/m$^2$ - Barrier - 161 g/m$^2$ | 370-450 microns | 1110-1350 microns | 832-1012 microns | 125-150 microns (94-113 microns) |

The edge strips 32*a*, 32*b* of the wrapper 30 can further have an exposed strip 46 of a material with adhesive properties on one or both faces. The adhesive strip can be provided on the wrapper 30 either prior to wrapping the roll 20 or once the roll 20 is wrapped. Reference is made to co-pending US published patent application no. 2006/0277866 for a detailed description of embodiments of this exposed strip 46 with adhesive properties. When wrapping the roll 20, the exposed strip 46 can be located on the face of the wrapper 30 in contact with the interior roll header 34 and/or the end 24 of the paper roll 20 and/or in contact with the exterior roll header 42, if any, i.e. the outer face of the wrapper 30.

For protecting the roll 20 from external moisture, the atmosphere, and physical abrasions, the wrapper can have moisture proof properties along its widths We, Wi or any width in between. The paper layers can be laminated with a material having moisture barrier properties such as PE, wax, an appropriate polymer or any other appropriate material.

Figure 10:
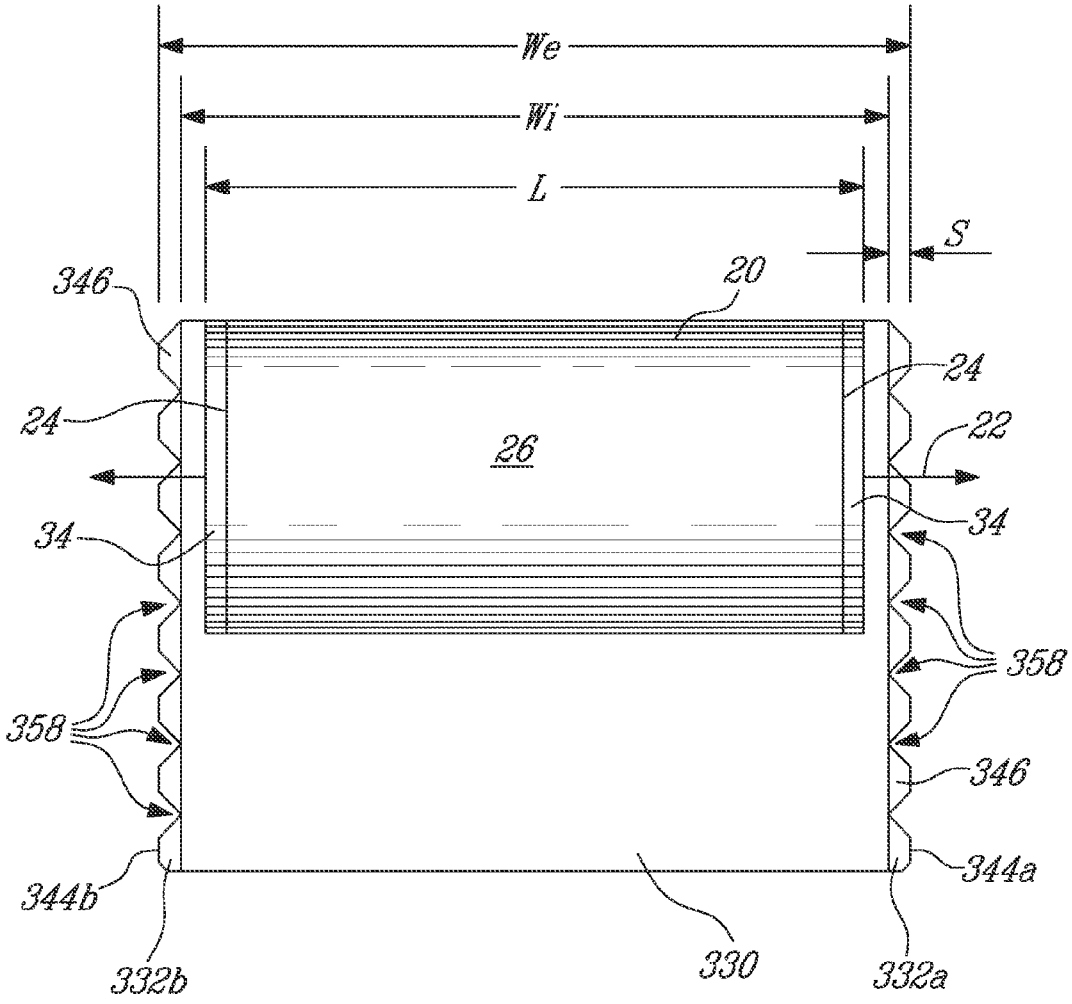
FIG. 10 is a top plan view of the paper roll being wrapped with a wrapper having waved edges in accordance with an embodiment of the invention.

Referring now to FIG. 10, another embodiment of the wrapper will be seen wherein the features are numbered with reference numerals in the 300 series. Contrary to the examples of FIGS. 4 to 9, the edges of the wrapper 330 are not straight edges, the edges 344*a*, 344*b* of the wrapper 330 are waved edges. The height of the ridges produced when the edge strips 332*a*, 332*b* are folded towards the roll ends 24 of the roll 20 with the waved edges is reduced. In the embodiment shown in FIG. 10, the waved edges are V-shaped grooves 358 cut into the edges 344 of the wrapper 330 and thereby forming substantially trapezoidal edges. The depth of the V-shaped grooves 358 can vary depending upon the characteristics of the wrapper 330. The V-shaped grooves 358 cut along the edges 344 of the wrapper 330 reduce the severity of the indentation produced by the ridges from the wrapper overlapped areas 338. In the embodiments shown, the V-shaped grooves 358 do not cut into the entire width of the edge strips 322*a*, 322*b*. The groove 358 extends over a shorter portion than the edge strips 322*a*, 322*b* to provide sufficient edge protection. In another embodiment, the V-shaped grooves 358 can be replaced by U-shaped grooves (not shown) or any other groove shape provided in the edges 344 of the wrapper 330.

The roll 20 can be any type of rolled paper including coated printing paper. However, it will appreciate that the above described technique and wrapper can be applied to any rolled material that needs to be wrapped and protected from liquids and/or moisture infiltration.

The wrapper can be manufactured on existing roll wrap extruders, laminators, and coater-laminators and can be applied to the roll 20 with existing roll wrapping equipments.

It will appreciate that the roll 20 can be wrapped one turn or more by the wrapper depending upon the physical properties of the wrapper.

Figure 11:
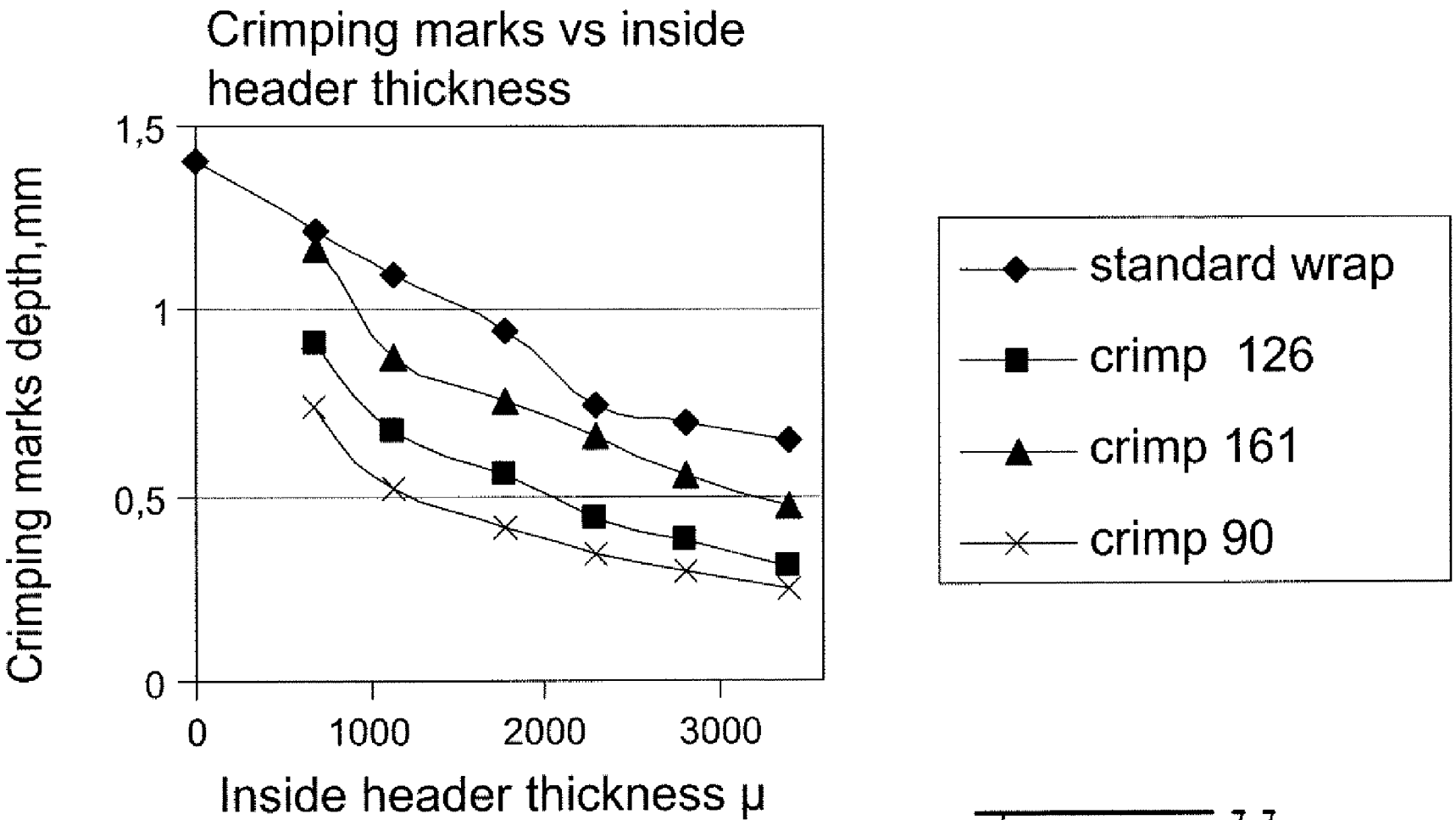
FIG. 11 is a graph representing the average depth of the crimping marks, in mm, versus the inside header thickness in μm, for a standard wrapper of the type where two layers of 126 g/m$^2$ are crimped (with diamonds), an asymmetrical wrapper in which the layer crimped is 161 g/m$^2$ (with triangles), an asymmetrical wrapper in which the layer crimped is 126 g/m$^2$ (with squares) and an asymmetrical wrapper in which the layer crimped is 90 g/m$^2$ (with crosses).

FIG. 11 is a graph representing the average depth of the crimping marks, in mm, versus the inside header thickness in μm, for a standard wrapper of the type where two layers of 126 g/m$^2$ are crimped (type 1) (with diamonds), an asymmetrical wrapper in which the layer crimped is 161 g/m$^2$ (with triangles), an asymmetrical wrapper in which the layer crimped is 126 g/m$^2$ (with squares) and an asymmetrical wrapper in which the layer crimped is 90 g/m$^2$ (with crosses).

Experiment

Seventeen paper rolls were wrapped with standard design wrappers and with asymmetrical wrappers. Different header thicknesses were used. Prior to wrapping the rolls, all packaging materials (heat sealable outside headers, chipboard inside headers, wrappers) were also conditioned to 23 deg.C. and 50% of relative humidity. The purpose was to keep the same compressibility of the different packaging materials. The rolls were stacked in a conditioned room at 23 deg.C. and 50% of relative humidity, and with the same stacking weight being applied on each paper rolls. The stacking period was 30 days. A paper roll without inside chipboard headers was wrapped and used as the reference for the standard wrapper. After the stacking period, the wrapper and the header, if any, on each paper roll was removed and, with a laser beam vernier, the crimping marks depth were accurately measured. In some areas of the roll edge, typically near the center, almost no crimping occurred and the edge has remained damage free. In areas closer to the outside perimeter of the roll edge, crimping has occurred and has created depressions in the roll edge surface. The highest point on the roll edge was determined to be at a position where no crimping occurred. Then, a comparative measurement was done between that point and the lowest point where crimping occurred and created a depression on the roll edge. That distance is the crimping marks depth measured.

Table 3 below shows the average crimping marks depth obtained for the laminated standard wrapper of type 1, with a composition of 126 g/m$^2$-barrier-126 g/m$^2$ wherein all layers are crimped, the laminated asymmetrical wrapper of example 3, with a composition of 161 g/m$^2$+barrier+90 g/m$^2$, wherein 161 g/m$^2$+barrier is the crimping zone thickness and the laminated asymmetrical wrapper of example 4, with a composition of 90 g/m$^2$+barrier+161 g/m$^2$, wherein 90 g/m$^2$+barrier is the crimping zone thickness. The average (avg) and standard deviation (s.d.) (in italics) crimping marks depth, in μm, was measured to be as follows in Table 3, for each header thickness tested and for each wrapper design.

TABLE 3

Average and standard deviation crimping mark thickness versus header thickness for different wrapper designs.

| | | | Header thickness | | | | | |
|---|---|---|---|---|---|---|---|---|
| | | No Header | 760 μm | 1140 μm | 1780 μm | 2290 μm | 2800 μm | 3400 μm |
| Standard Type 1 | avg | 1.403 | 1.219 | 1.098 | 0.948 | 0.746 | 0.695 | 0.652 |
| | s.d. | 0.110 | 0.148 | 0.098 | 0.058 | 0.060 | 0.047 | 0.035 |
| Laminated Assymetrical Example 3 | avg | N/A | 1.172 | 0.870 | 0.759 | 0.666 | 0.555 | 0.474 |
| | s.d. | N/A | 0.031 | 0.070 | 0.056 | 0.040 | 0.043 | 0.040 |
| Laminated Assymetrical Example 4 | avg | N/A | 0.781 | 0.519 | 0.434 | 0.348 | 0.299 | 0.252 |
| | s.d. | N/A | 0.108 | 0.067 | 0.029 | 0.031 | 0.025 | 0.025 |

The embodiments of the invention described above are intended to be exemplary only. Several alternatives are possible. The scope of the invention is therefore intended to be limited solely by the scope of the appended claims.

The invention claimed is:

1. A paper roll wrapper for wrapping on a roll of length (L) having two opposed roll ends, the wrapper comprising:

a single interior paper layer of a length (Wi) and of an interior layer basis weight, juxtaposable to said roll when said wrapper is wrapped on said roll;

a single exterior paper layer of a length (We) longer than said length (Wi) of said interior paper layer forming at least one end strip of width (S) and of an exterior paper layer basis weight, adapted to be outside of said roll when said wrapper is wrapped on said roll;

said interior layer basis weight being different from said exterior layer basis weight;

said end strip of said exterior paper layer foldable on a corresponding one of said roll ends during crimping following wrapping of said wrapper on said roll.

2. A paper roll wrapper as claimed in claim 1, wherein said length (Wi) is at least equal to (L).

3. A paper roll wrapper as claimed in claim 2, wherein said length (Wi) is substantially equal to (L).

4. A paper roll wrapper as claimed in claim 1, wherein said exterior basis weight is lower than said interior basis weight.

5. A paper roll wrapper as claimed in claim 1, further comprising a moisture barrier layer adapted to be received between said interior and said exterior paper layers.

6. A paper roll wrapper as claimed in claim 5, wherein said moisture barrier layer is laminated.

7. A paper roll wrapper as claimed in claim 1, wherein said interior layer basis weight is 161 g/m2.

8. A paper roll wrapper as claimed in claim 1, wherein said exterior layer basis weight is 90 g/m2.

9. A protective wrapping paper for a roll having two spaced-apart roll ends and an outer roll surface extending between the roll ends on a length (L), the protective wrapping paper comprising:

an interior paper layer of a length (Wi) and of an interior layer basis weight, the interior paper layer being juxtaposed to the outer roll surface when said wrapping paper is wrapped on said roll; and an exterior paper layer of a length (We), longer that the length (Wi) of the interior paper layer, and of an exterior layer basis weight, different from the interior layer basis weight, the exterior paper layer being superposed to the interior paper layer and defining therewith at least one end strip of a width (S), the at least one end strip being foldable on a corresponding one of said roll ends.

10. A protective wrapping paper as claimed in claim 9, wherein the exterior paper layer is directly superposed to the interior paper layer.

11. A protective wrapping paper as claimed in claim 9, comprising a moisture barrier layer laminated between the interior paper layer and the exterior paper layer.

12. A protective wrapping paper as claimed in claim 9, comprising two spaced-apart end strips and a peripheral strip extending between the end strips, the length (We) being substantially equal to the length of the end strips and of the peripheral strip and the length (Wi) being substantially equal to the length of the peripheral strip.

13. A wrapped roll, comprising:

a roll of length (L) having two spaced-apart roll ends and an outer roll surface extending between the roll ends; and a wrapping paper having an interior paper layer of a length (Wi) and of an interior layer basis weight and an exterior paper layer of a length (We) longer than the length (Wi) of the interior paper layer forming at least one end strip of width (S) and of an exterior layer basis weight, the interior paper layer being juxtaposed to the outer roll surface, the interior layer basis weight being different than the exterior layer basis weight, the end strip of the exterior paper layer being folded on a corresponding one of the roll ends.

14. A wrapped roll as claimed in claim 13, wherein the at least one end strip of the wrapping paper is crimped to the corresponding one of the roll ends.

15. A wrapped roll as claimed in claim 13, wherein the exterior paper layer of the wrapping paper is exposed.

16. A wrapped roll as claimed in claim 13, wherein the length (Wi) is at least equal to the length (L).

17. A wrapped roll as claimed in claim 13, wherein the exterior layer basis weight is lower than the interior layer basis weight.

18. A wrapped roll as claimed in claim 13, comprising a moisture barrier layer extending between the interior and the exterior paper layers.

19. A wrapped roll as claimed in claim 13, comprising two spaced-apart end strips and a peripheral strip extending between the end strips, the length (We) being substantially equal to the length of the end strips and of the peripheral strip and the length (Wi) being substantially equal to the length of the peripheral strip.

20. A wrapped roll as claimed in claim 19, wherein the length of the peripheral strip is substantially equal to the length (L) of the roll.

* * * * *